US008485362B2

(12) United States Patent
Chan et al.

(10) Patent No.: US 8,485,362 B2
(45) Date of Patent: Jul. 16, 2013

(54) CUSHION AND PACKAGE

(75) Inventors: Tai-Ling Chan, Hsin-Chu (TW); Chung-Kuan Ting, Hsin-Chu (TW)

(73) Assignee: AU Optronics Corporation, Hsin-Chu (TW)

( * ) Notice: Subject to any disclaimer, the term of this patent is extended or adjusted under 35 U.S.C. 154(b) by 0 days.

(21) Appl. No.: 13/107,362

(22) Filed: May 13, 2011

(65) Prior Publication Data

US 2012/0055825 A1 Mar. 8, 2012

(30) Foreign Application Priority Data

Sep. 6, 2010 (TW) ..... 99130098 A

(51) Int. Cl.
*B65D 85/30* (2006.01)

(52) U.S. Cl.
USPC ..... 206/586; 206/592; 248/345.1

(58) Field of Classification Search
USPC ..... 206/585, 586, 591, 592, 593, 594, 206/521, 814; 248/345.1
See application file for complete search history.

(56) References Cited

U.S. PATENT DOCUMENTS

| | | | | | |
|---|---|---|---|---|---|
| 3,356,209 | A | * | 12/1967 | Pezely, Jr. | 206/523 |
| 4,287,265 | A | * | 9/1981 | McKnight | 267/140.3 |
| 5,339,958 | A | * | 8/1994 | Taravella et al. | 206/521 |
| 5,341,934 | A | * | 8/1994 | Hsu | 206/591 |
| 5,692,618 | A | * | 12/1997 | Beak | 206/586 |
| 6,116,423 | A | * | 9/2000 | Troxtell et al. | 206/523 |
| 7,588,148 | B2 | * | 9/2009 | Yang | 206/523 |
| 7,946,426 | B2 | * | 5/2011 | Ohsawa et al. | 206/586 |
| 2005/0161366 | A1 | * | 7/2005 | Kobashi et al. | 206/586 |

FOREIGN PATENT DOCUMENTS

| | | | |
|---|---|---|---|
| JP | 55084270 | U | 6/1980 |
| JP | 2009023708 | A | 2/2009 |
| JP | 2010030636 | A | 2/2010 |

OTHER PUBLICATIONS

European Search Report cited on Dec. 1, 2011.

* cited by examiner

*Primary Examiner* — Jacob K Ackun
(74) *Attorney, Agent, or Firm* — WPAT, PC; Justin King

(57) ABSTRACT

A cushion includes a main body, a receiving space, and at least one stand. The main body has a slot therein. The receiving space is disposed in the main body. The stand is telescopically received in the receiving space.

24 Claims, 11 Drawing Sheets

CUSHION AND PACKAGE

RELATED APPLICATIONS

This application claims priority to Taiwan Application Serial Number 099130098, filed Sep. 6, 2010, which is herein incorporated by reference.

BACKGROUND

1. Technical Field

The present disclosure relates to packaging.

2. Description of Related Art

The increasingly intense competition in consumer electronics leads to the development of large screen and thin LCDs (Liquid Crystal Displays). Currently, the LCDs on the market tend to be large sized but thin. In order to package this kind of LCDs, the cartons have to be large sized but thin as well. However, their centers of gravity are too high, and their bottom areas are too small. Hence, this kind of cartons can not stand alone stably and are very prone to rolling over, which may break the LCDs packaged in the cartons.

Recently, LED (Light Emitting Diod)-backlight LCDs have raised rapidly. The use of LED backlighting results in a thinner panel. Therefore, the related manufacturers must do their best to thin their products since the thin shape is a strong selling point for the LED-backlight LCDs. However, this will create a more serious stability problem for the LED-backlight LCDs when they stand alone.

Although the manufacturers can reduce the risk of rolling over by increasing the bottom areas of the cartons, this will result in an increase in the packaging cost. Furthermore, increasing the bottom areas of the cartons also increases the volume of the cartons. This will result in an increase in the transportation cost and reduce the competitiveness of their products.

SUMMARY

According to one embodiment of the present invention, a cushion includes a main body, a receiving space, and at least one stand. The main body has a slot therein. The receiving space is disposed in the main body. The stand is telescopically received in the receiving space.

According to another embodiment of the present invention, a cushion includes a main body and at least one first stand. The main body has a receiving space located on the corner of the main body. The receiving space goes through at least one side surface of the main body. The first stand is received in the receiving space, wherein the outer side surface of the first stand is exposed from the side surface of the main body.

According to still another embodiment of the present invention, a package includes a carton, at least one cushion, a receiving space, at least one stand, an opening, and a stand flap. The carton is for containing a liquid crystal display. The cushion is disposed at least in a bottom corner of the carton for filling a void between at least one bottom corner of the liquid crystal display and the carton. The receiving space is disposed in the cushion. The stand is moveable relative to the receiving space. The opening is disposed in the carton to expose the receiving space to allow the stand to be moved out of the carton through the opening. The stand flap is for covering the opening.

DETAILED DESCRIPTION

Figure 1:
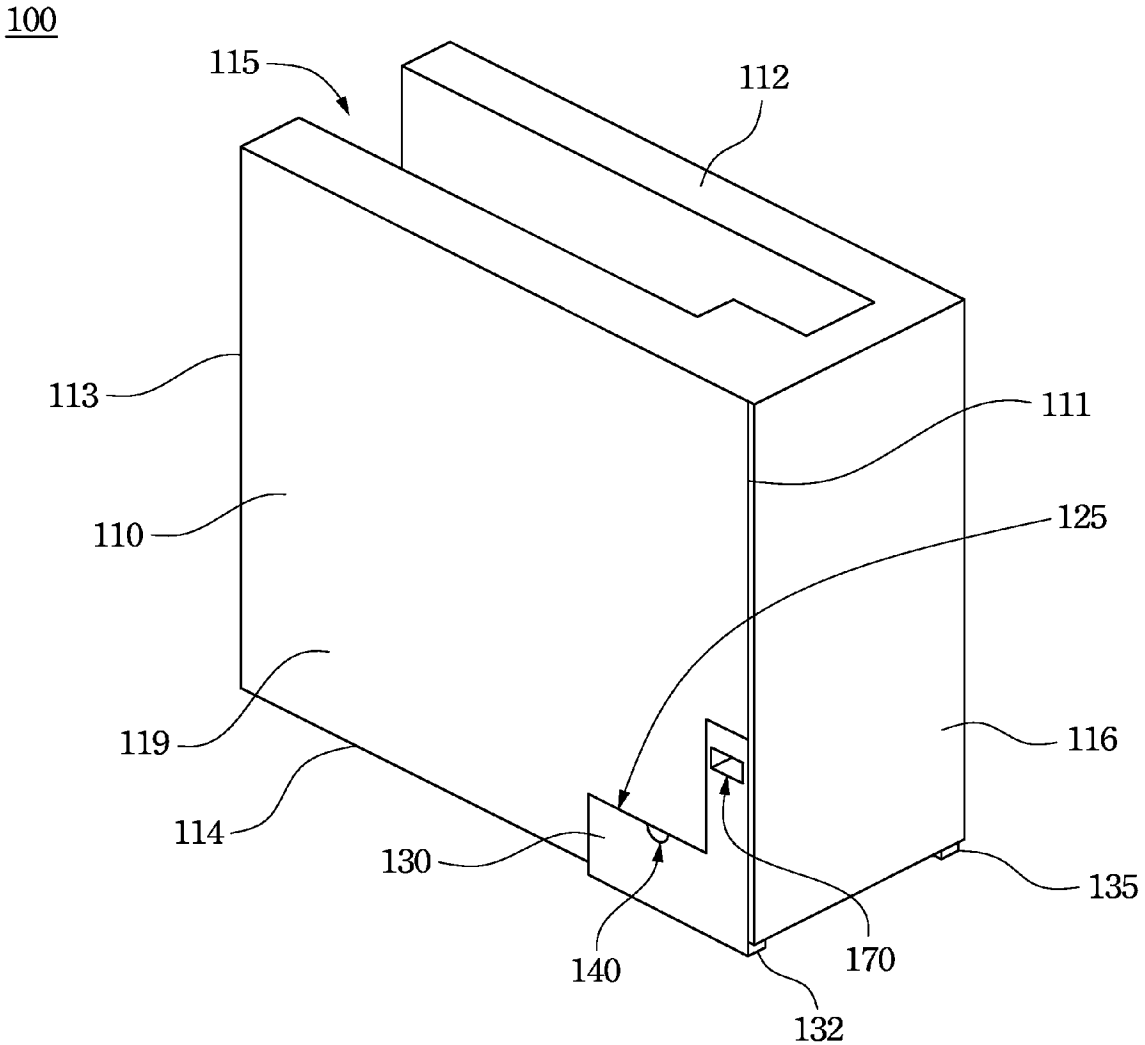
FIG. 1 is a three dimensional view of a cushion according to one embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
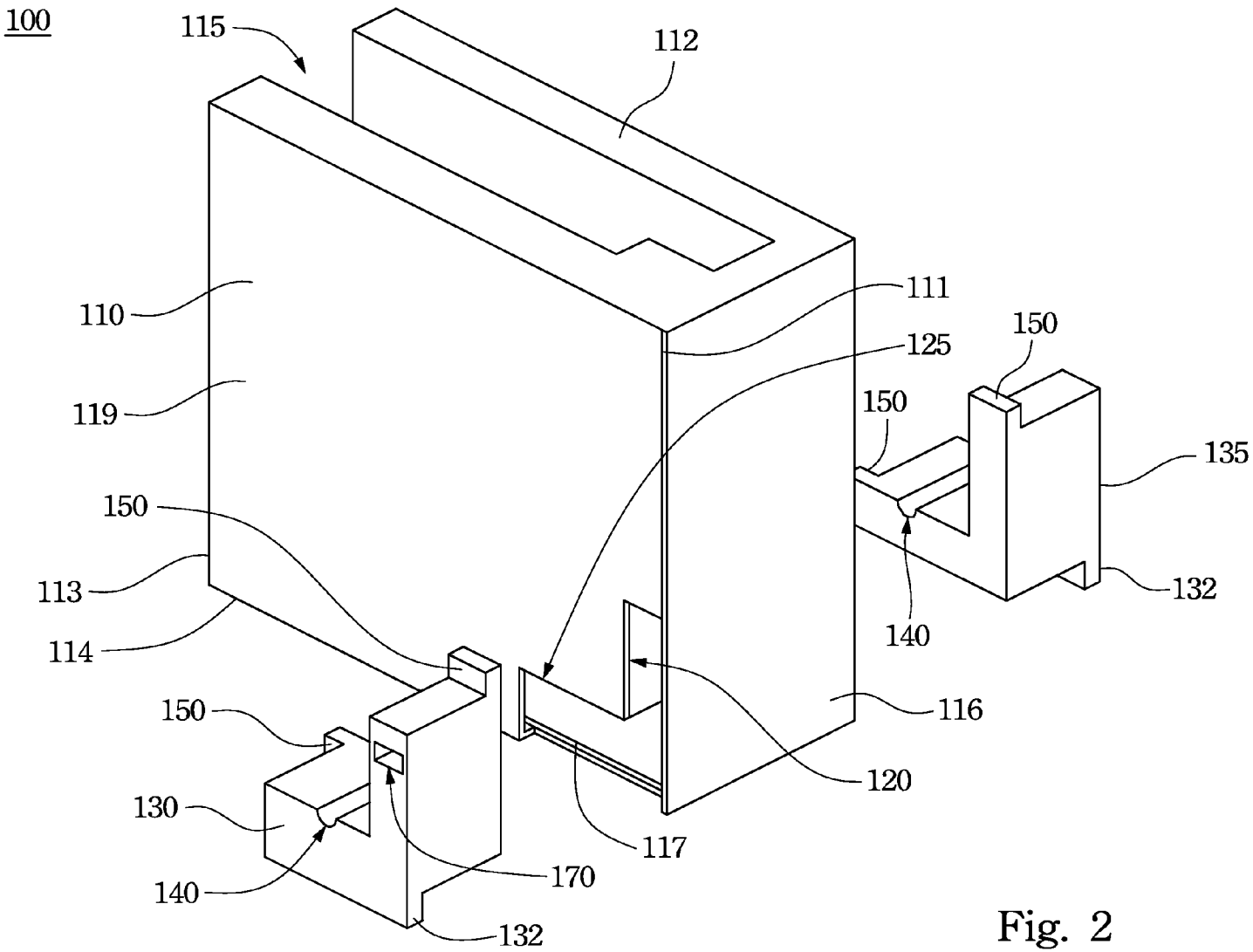
FIG. 2 is an exploded view of the cushion of FIG. 1.
Figure 3:
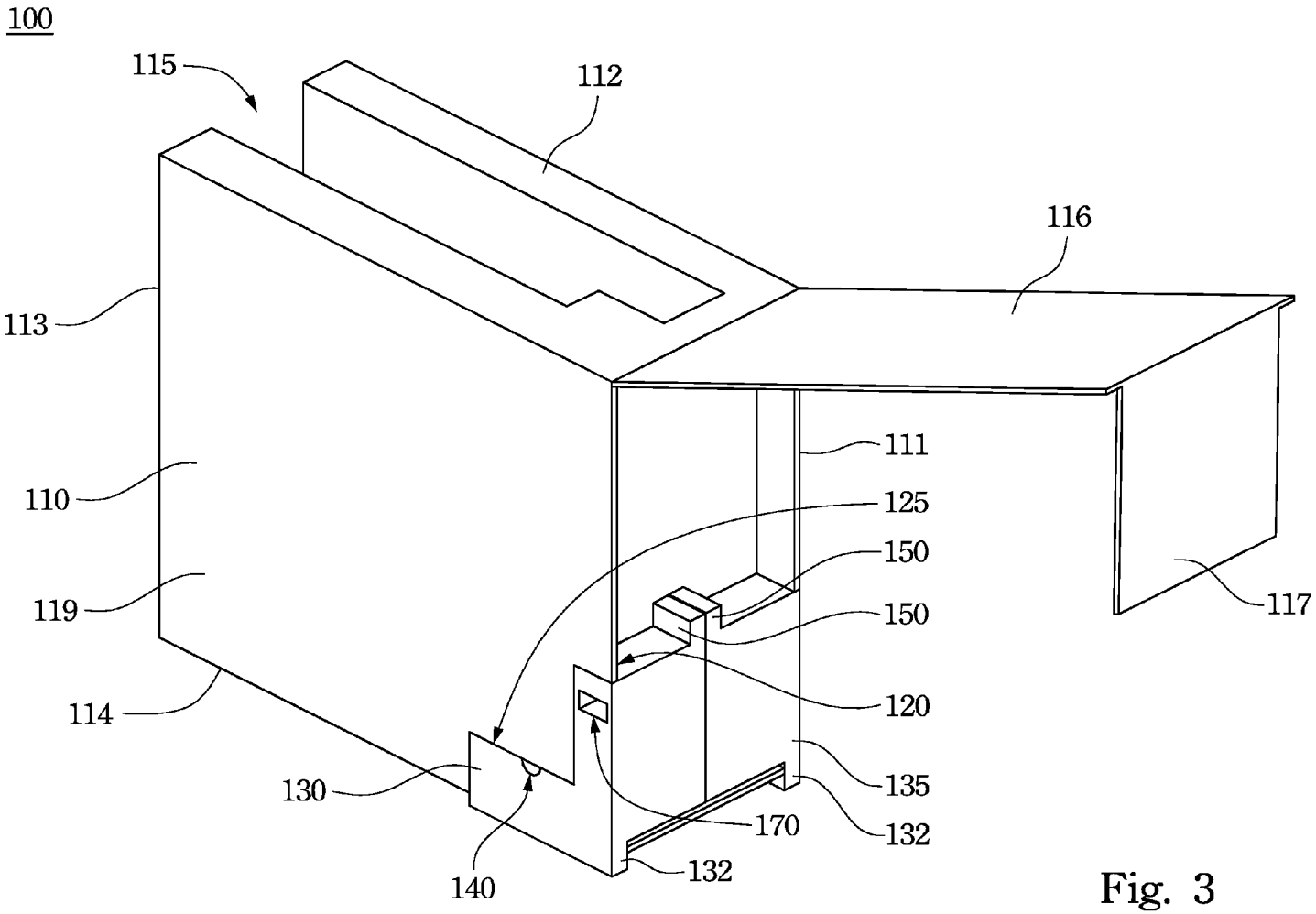
FIG. 3 is a three dimensional view of the cushion of FIG. 1, depicting the receiving space flap is swung to an open position.

FIG. 1 is a three dimensional view of a cushion according to one embodiment of the present invention. FIG. 2 is an exploded view of the cushion of FIG. 1. FIG. 3 is a three dimensional view of the cushion of FIG. 1, depicting the receiving space flap is swung to an open position. As shown in FIGS. 1-3, a cushion 100 includes a main body 110, a receiving space 120, and at least one first stand 130. The main body 110 has a slot 115 therein. The receiving space 120 is disposed in the main body 110. The first stand 130 is telescopically received in or moveable relative to the receiving space 120.

The main body 110 of FIG. 1 has a first surface 111, a second surface 112, a third surface 113, and a forth surface 114. The first surface 111 is opposite the third surface 113. The second surface 112 is adjacent to one side of the first surface 111 and one side of the third surface 113. The forth surface 114 is adjacent to another side of the first surface 111 and another side of the third surface 113. The second surface 112 has a slot 115 therein. The slot 115 goes through to the third surface 113.

The main body 110 of FIG. 1 may be made of paper, plastic foam, or combinations thereof. Specifically, the main body 110 can be made of, for example, corrugated fiberboard, EPS (Expanded Poly-Styrolene), EPP (Expanded Poly-Propylene), EPE (Expanded Poly Ephylene), etc.

In the present embodiment, the bottom edge of the receiving space 120 is substantially level with the bottom edge of the main body 110. In this arrangement, the first stand 130 can be pulled out of the receiving space 120 and makes contact with the ground, thereby allowing the LCD to be kept upright without rolling over. Specifically, the receiving space 120 of FIG. 2 is located on the corner of the main body 110 and goes through at least one side surface 119 of the main body 110.

The receiving space 120 may have many variations. For example, the receiving space 120 may be a hole with a closed side when the main body 110 is made of paper. Specifically, the main body 110 of FIGS. 1-3 may include a receiving space flap 116. The receiving space flap 116 covers the first surface 111, and this receiving space flap 116 has a side edge connected to the junction of the first surface 111 and the second surface 112.

The receiving space flap 116 may have an insert flap 117. In use, a user may insert the insert flap 117 into a gap between the first stand 130 and the forth surface 114 of the main body 110, i.e. the bottom surface of the main body 110. In this way, the receiving space flap 116 can close one side of the receiving space 120. That is, the receiving space flap 116 defines at least one side wall of the receiving space 120 and restrains the first stand 130 in the receiving space 120.

Figure 4:
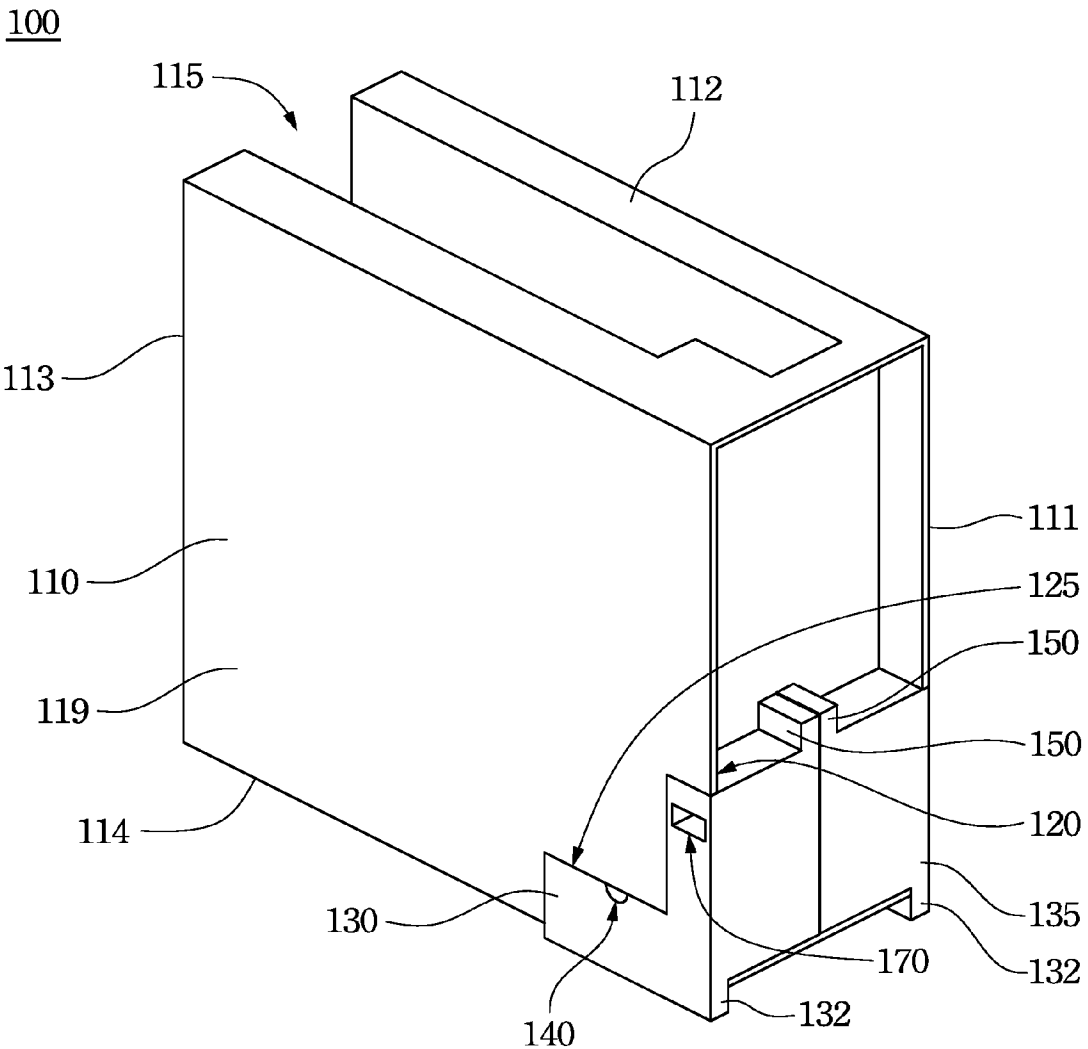
FIG. 4 is a three dimensional view of a cushion according to another embodiment of the present invention.

Alternatively, the receiving space 120 may be an indentation on the corner of the main body 110 with an open side (as shown in FIG. 4). The difference between FIG. 4 and FIG. 1 is that: the main body 110 of FIG. 4 does not have the receiving space flap 116. Therefore, the receiving space 120 of FIG. 4 is open-sided. In use, a user may put the first stand 130 into the receiving space 120 and then restrain the first stand 130 in the receiving space 120 by a carton. This arrangement suits the situation that the receiving space flap 116 can not be provided easily, for example, when the main body 110 is made of plastic foam.

The first stand 130 is received in the receiving space 120. The outer side surface of the first stand 130 is exposed from the side surface 119 of the main body 110. As shown in FIGS. 2-4, the main body 110 has an opening 125 in its side surface 119. The opening 125 is connected to the receiving space 120. The first stand 130 may have at least one stopping part 150, specifically two stopping parts 150 shown in FIGS. 2-4. The stopping parts 150 are disposed on the inner side surface of the first stand 130 and protrude from the first stand 130. Furthermore, the stopping parts 150 are out of the projection of the opening 125 on the inner side surface of the first stand 130. In this way, the stopping parts 150 can be against the inner surface of the receiving space 120 for stopping the first stand 130 from being moved out of the receiving space 120 when the first stand 130 protrudes a predetermined distance from the receiving space 120.

The first stand 130 may be made of paper, plastic foam, or combinations thereof. Specifically, the first stand 130 can be made of, for example, corrugated fiberboard, EPS (Expanded Poly-Styrolene), EPP (Expanded Poly-Propylene), EPE (Expanded Poly Ephylene), etc.

As shown in FIGS. 1-3, the receiving space 120 may be a through hole going through the main body 110. Furthermore, the cushion 100 of this embodiment may further include a second stand 135. Both of the first stand 130 and the second stand 135 are received in the receiving space 120. The outer side surface of the second stand 135 is exposed from another side surface of the main body 110.

Figure 5:
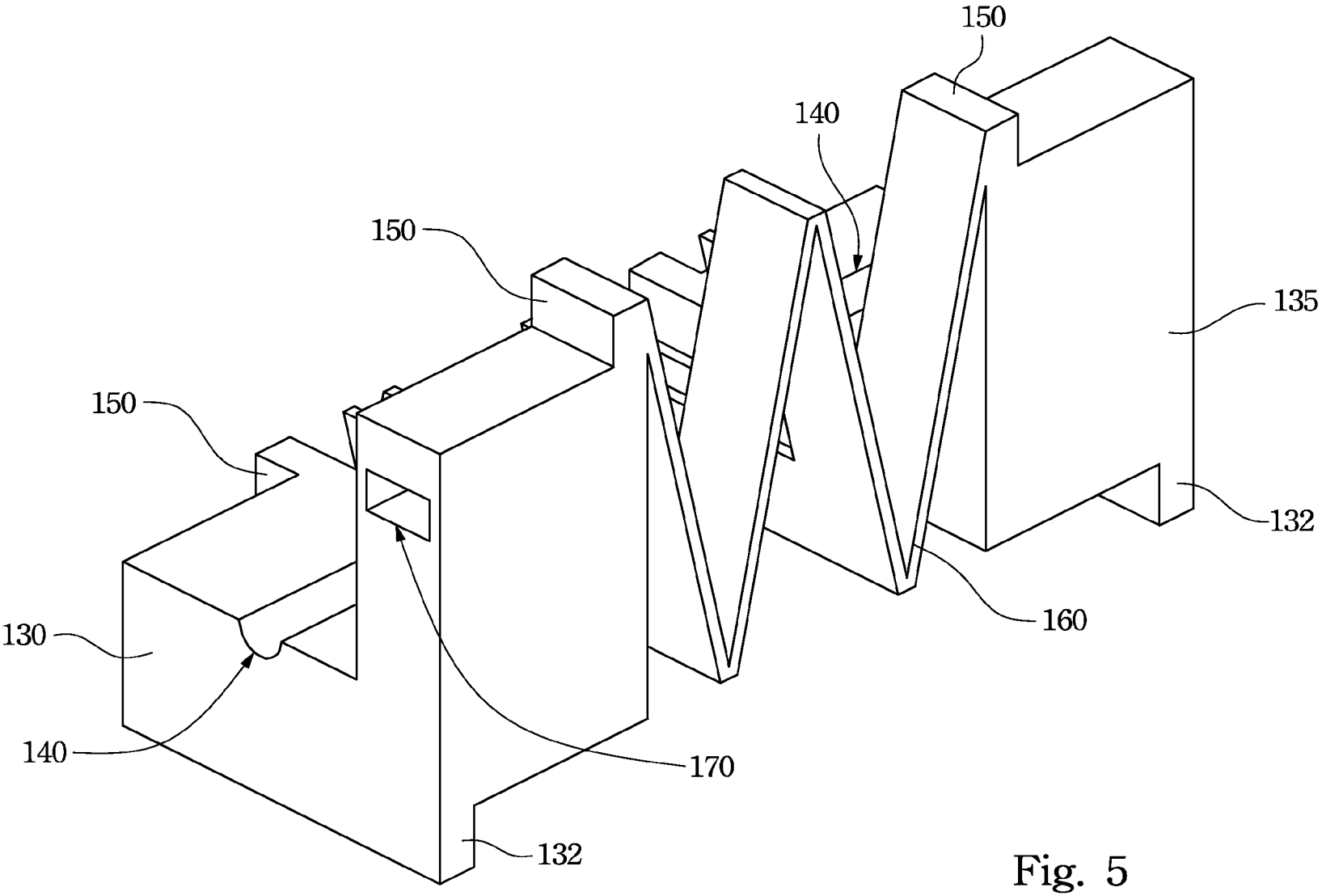
FIG. 5 is a three dimensional view of stands according to yet another embodiment of the present invention.

That is, the number of the stands of this embodiment is two. One is the first stand 130, and the other is the second stand 135. The first stand 130 and the second stand 135 are telescopically received in or moveable relative to opposite sides of the receiving space 120. Although the first stand 130 and the second stand 135 shown in FIGS. 1-3 are separated elements, this should not limit the scope of the invention. In one or more embodiments, the cushion 100 may further include a connecting part 160. The connecting part 160 is disposed between and connects the first stand 130 and the second stand 135 (as shown in FIG. 5).

The structural details and the material of the second stand 135 are the same as the structural details and the material of the first stand 130 and are not repeated hereinafter.

In one or more embodiments, the cushion 100 may further include finger holes 140 respectively disposed in the outer side surface of the first stand 130 and the outer side surface of the second stand 135. In use, a user may insert his/her finger (s) into the finger hole(s) 140 to pull the first stand 130/the second stand 135 out of the receiving space 120. Although the number of the finger hole(s) 140 in each of the first stand 130 and the second stand 135 shown in FIGS. 1-5 is one, the number of the finger hole(s) 140 in each of the first stand 130 and the second stand 135 may be two, three, or other suitable number.

The finger hole(s) 140 may have many variations. Although the finger hole(s) 140 shown in FIGS. 1-5 is semicircular, the finger hole(s) 140 in one or more embodiments may be circular, elliptical, circular-like, polygonal, or other suitable shape.

Figure 6:
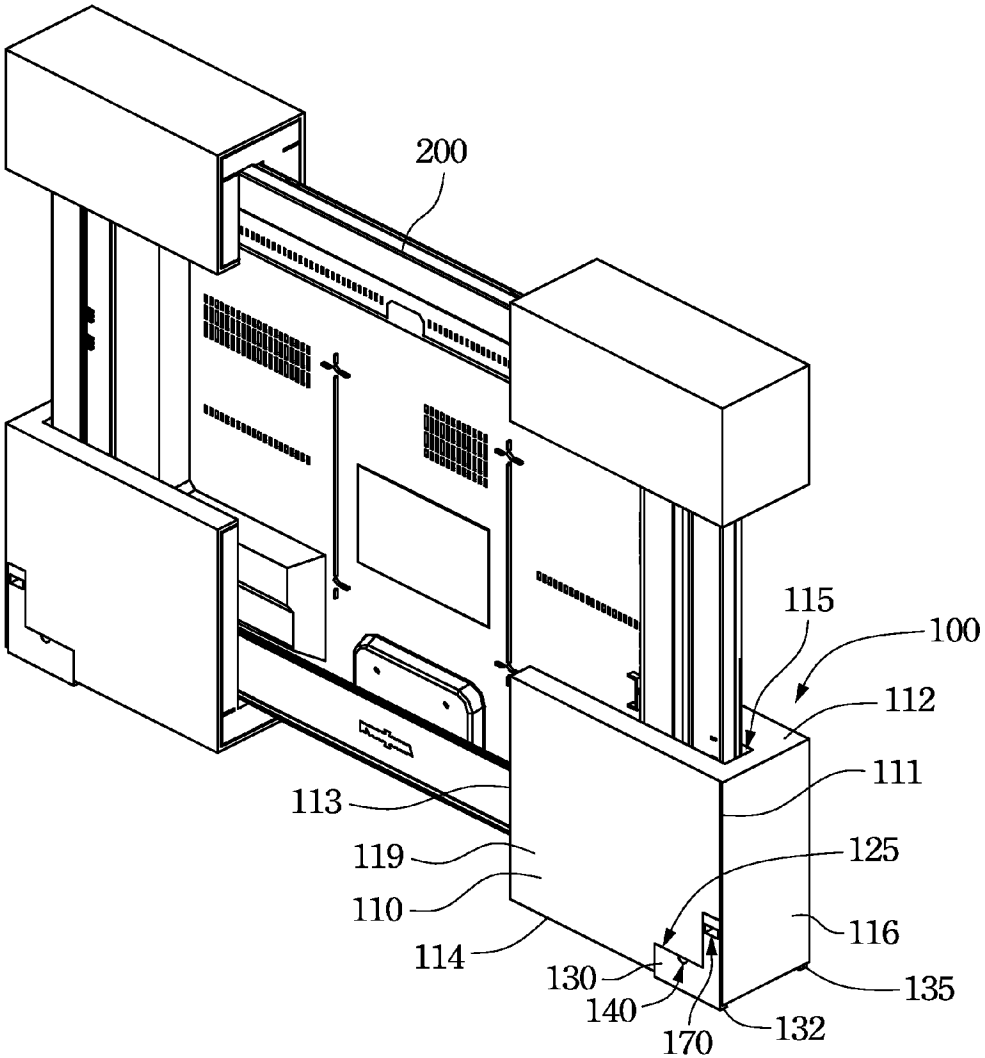
FIG. 6 is a three dimensional view of the cushion of FIG. 1 in use.

FIG. 6 is a three dimensional view of the cushion 100 of FIG. 1 in use. As shown in FIG. 6, in use, a user may use a pair of the cushions 100 to protect the bottom corners of the liquid crystal display 200 and use a pair of normal cushions or the cushions 100 of FIG. 1 to protect the top corners of the liquid crystal display 200. Then, the whole structure may be put into a carton. At this time, the cushions can fill a void between the four corners of the liquid crystal display and the carton to protect the liquid crystal display from being damaged by being dropped or impacted.

Figure 7:
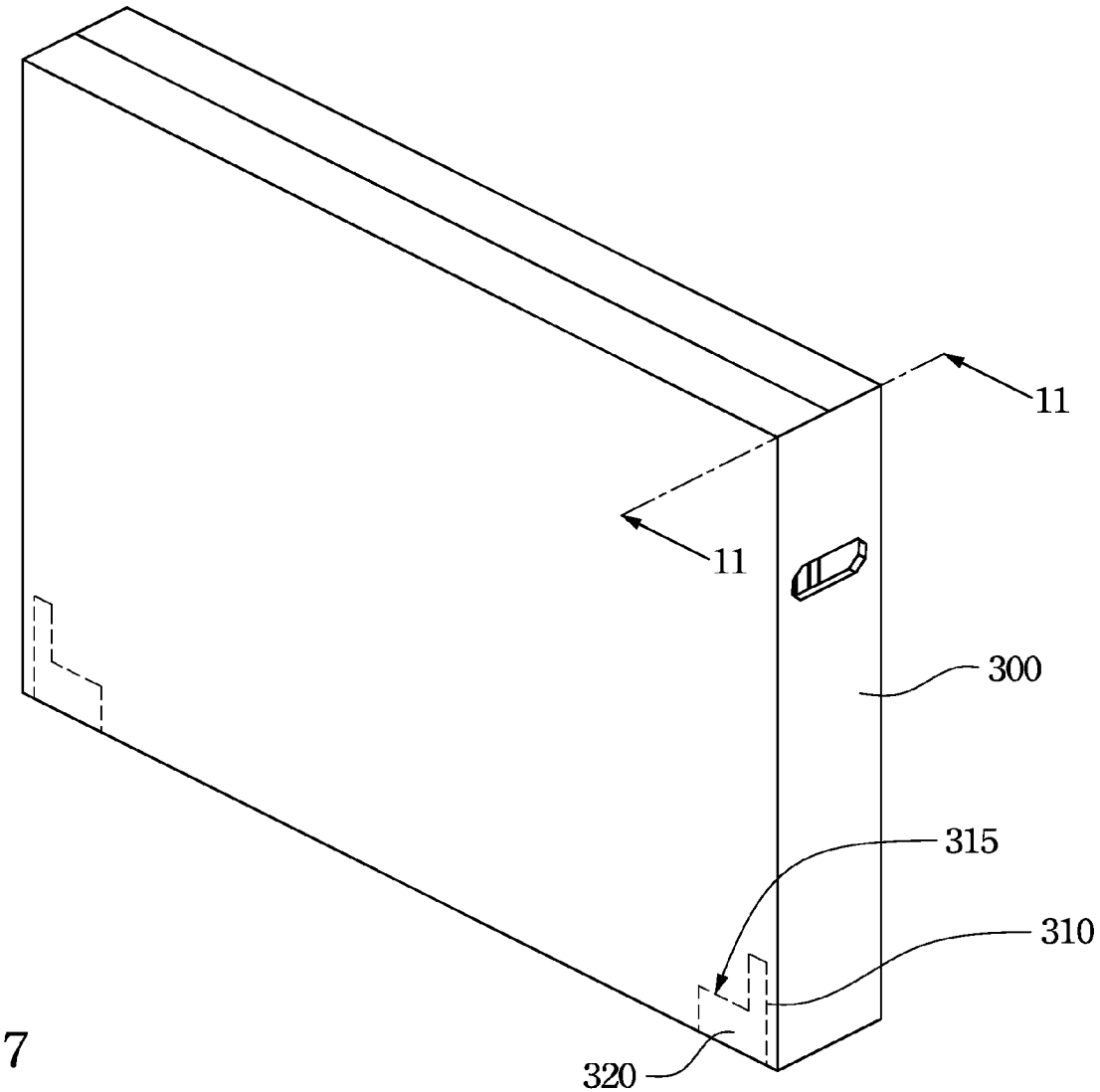
FIGS. 7-10 are three dimensional views of a package according to one embodiment of the present invention.
Figure 8:
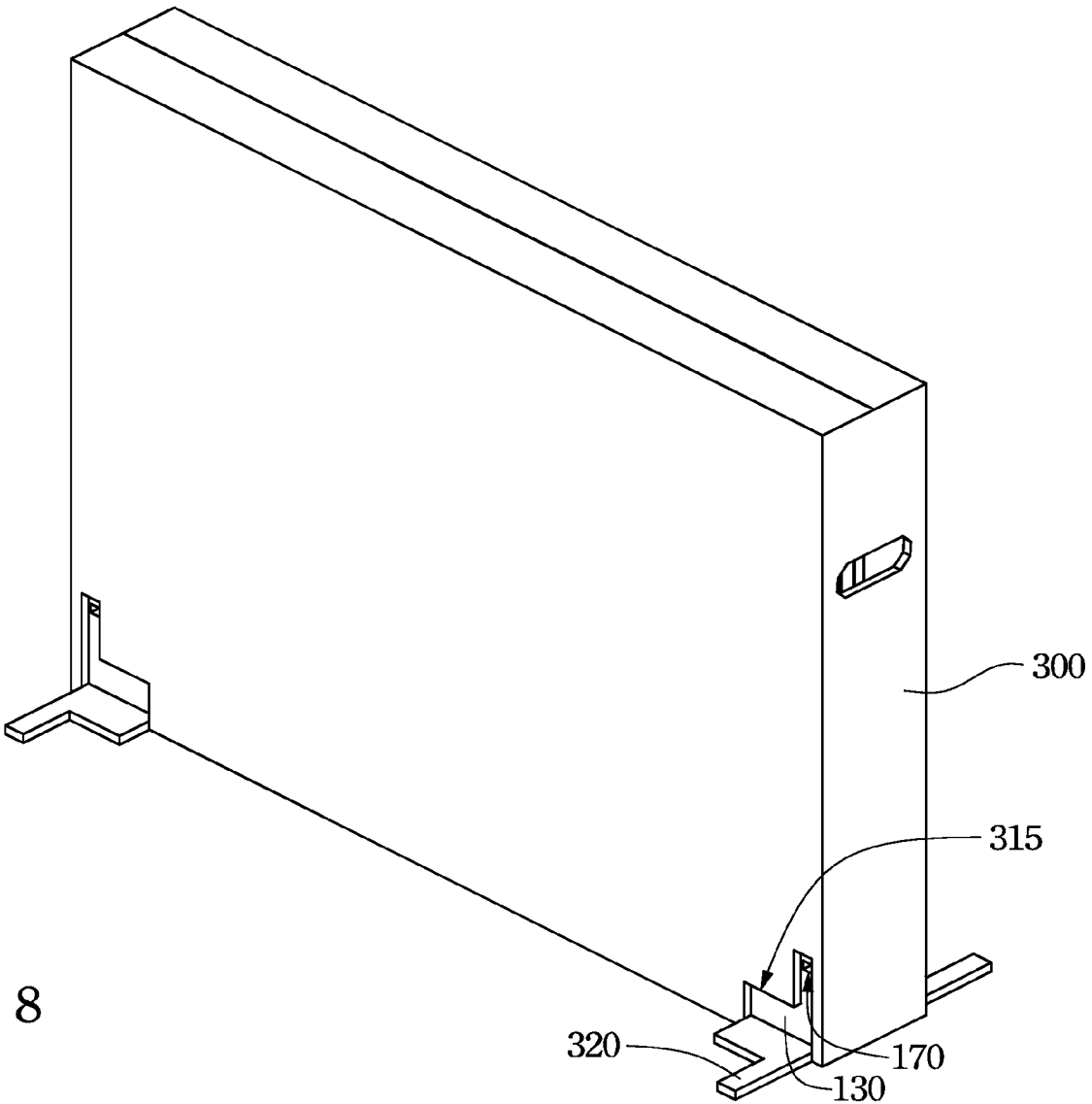

FIG. 7 is a three dimensional view of a carton 300 containing the liquid crystal display and the cushions 100 of FIG. 1. As shown in FIG. 7, the carton 300 may have one or more pre-broken lines, e.g. perforated lines, on its side wall. In one or more embodiments, the pre-broken lines 310 may be substantially aligned with the peripheries of the receiving spaces 120. Alternatively, the pre-broken lines 310 may be substantially aligned with the peripheries of the first stands 130 and the second stands 135 when the tolerance between the first stands 130/the second stands 135 and the corresponding receiving space 120 is too large. In use, a user may tear the side wall of the carton 300 along the pre-broken lines 310 to form the openings 315 (as shown in FIG. 8) to allow the first stands 130 and the second stands 135 to be moved out of the carton 300 through the openings 315.

The terms "substantially" as used herein may be applied to modify any structural cooperation which could permissibly vary without resulting in a change in the basic function to which it is related. For example, the pre-broken lines 310 as disclosed herein aligned with the peripheries of the receiving spaces 120 may permissibly vary if the first stands 130 and the second stands 135 can be moved out of the carton 300 through the openings 315 formed by tearing along the pre-broken lines 310.

In other words, the pre-broken lines 310 define stand flaps 320 which cover the first stands 130 and the second stands 135, i.e. the openings 315. In use, a user may tear off the stand flaps 320 along the pre-broken lines 310 to expose the openings 315 in the side wall of the carton 300 (as shown in FIG. 8). Since the pre-broken lines 310 are substantially aligned with the peripheries of the receiving spaces 120, the exposed openings 315 can be aligned with the receiving spaces 120, such that the first stands 130 and the second stands 135 can be moved out of the carton 300 through the openings 315.

In one or more embodiments, the pre-broken lines 310 may be, for example, perforated lines. That is, there are a plurality of connecting points arranged on the edges of the stand flaps 320 to form the pre-broken lines 310. The connecting points connect the stand flaps 320 to the carton 300. In use, a user may tear or cut the connecting points along the pre-broken lines 310 to open the stand flaps 320 and to expose the openings 315 in the carton 300 (as shown in FIG. 8) when the carton is made of paper.

In one or more embodiments, the stand flaps 320 may be connected to the bottom edge of the carton 300. In this way, the opened stand flaps 320 can be disposed on the ground to support the first stands 130 and the second stands 135 and fill a void between the first stands 130/the second stands 135 and the ground to prevent the carton 300 from rolling motion.

Figure 9:
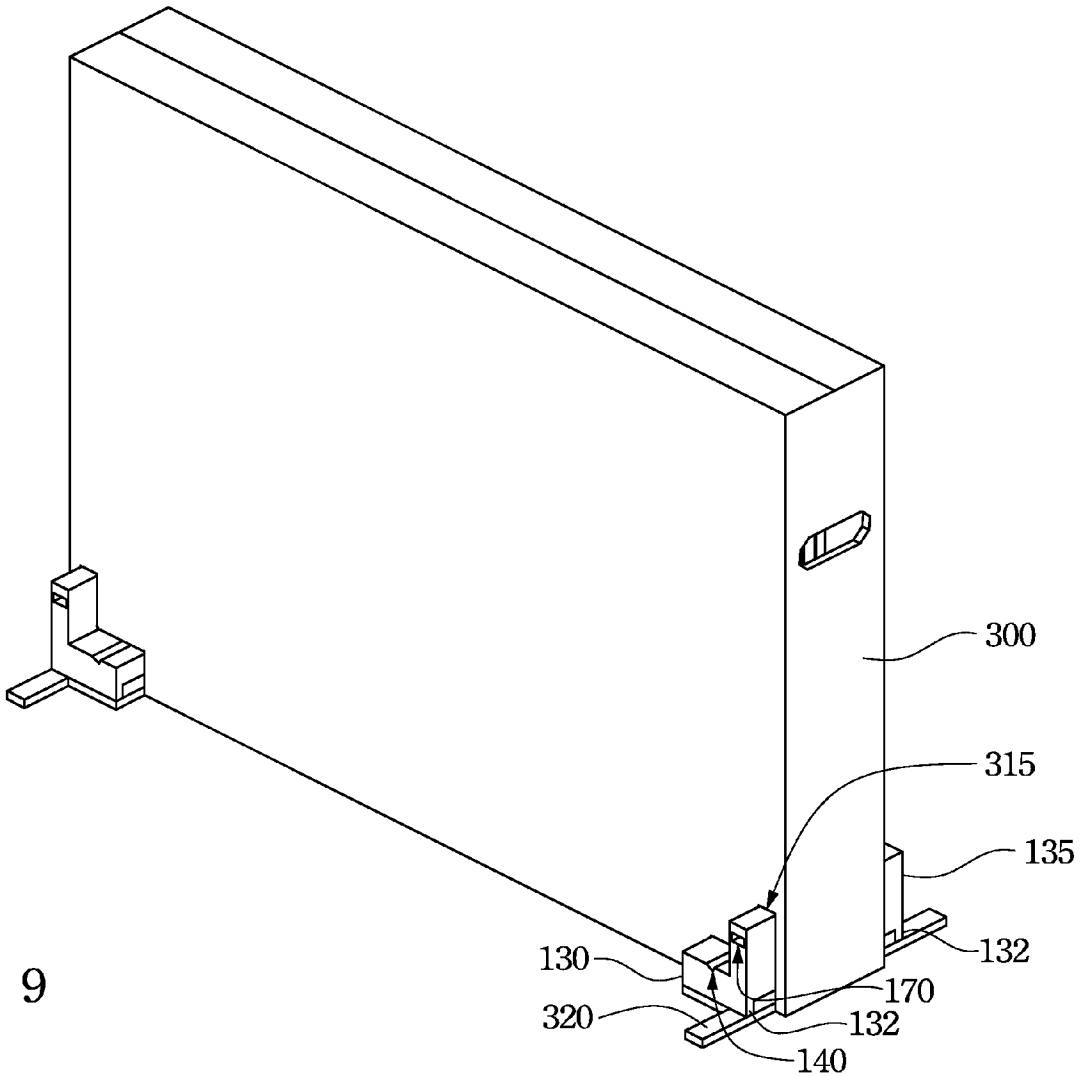

As shown in FIG. 9, the first stands 130 and the second stands 135 may be located at the four bottom corners of the carton 300 respectively. In this way, the first stands 130 and the second stands 135 can evenly resist the moment of the force tending to roll the carton 300. Therefore, the carton 300 can stand alone stably. In order to cover the first stands 130 and the second stands 135, the stand flaps 320 are also located at the four bottom corners of the carton 300 respectively.

Figure 10:
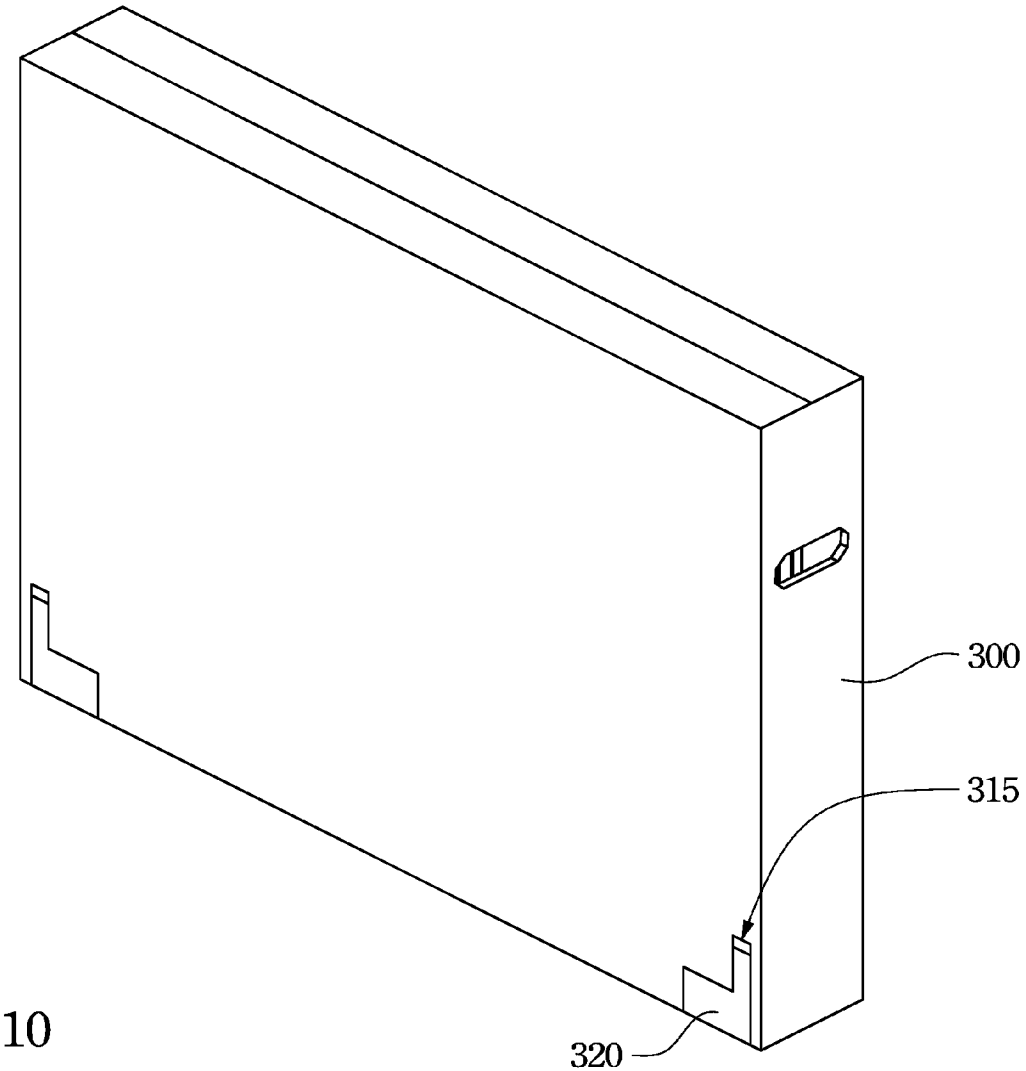

Reference is made to FIGS. 9-10. When a user want to telescope the first stands 130 and the second stands 135, the user may push the first stands 130 and the second stands 135 back to the receiving spaces 120 and then close the stand flaps 320. There are many ways to fix the closed stand flaps 320. For example, there may be a flap hole 170 in each of the first stands 130 and the second stands 135 to allow the closed stand flaps 320 to be inserted therein. Alternatively, when there is no flap hole 170 in each of the first stands 130 and the second stands 135, a user may restrain the closed stand flaps 320 in the openings 315 to fix the closed stand flaps 320 as well.

Figure 11:
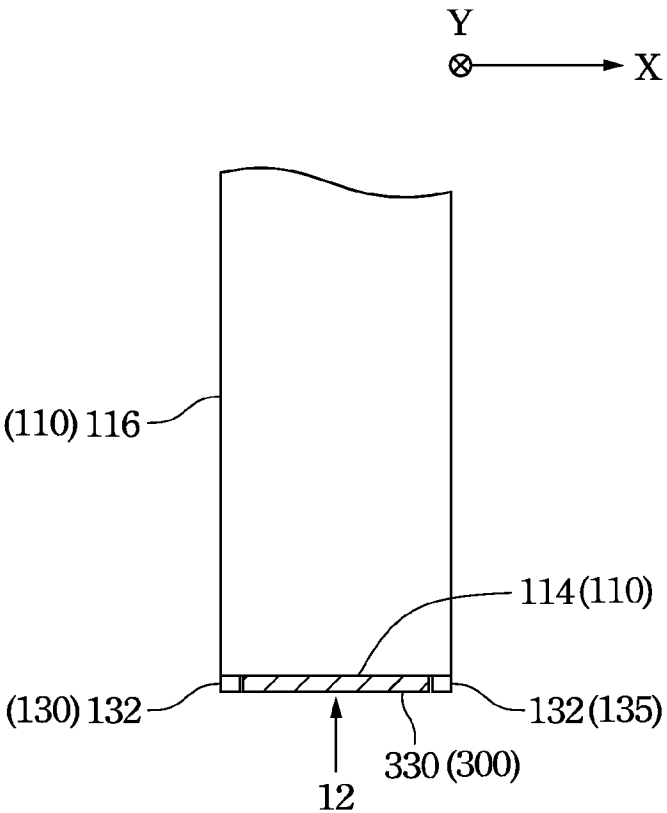
FIG. 11 is a sectional view taken along line 11-11 of FIG. 7.

As shown in FIGS. 1-5, each of the first stands 130 and the second stands 135 has a supporting part 132 disposed on its outer side surface. These supporting parts 132 protrude from the first stands 130 and the second stands 135 respectively. After the first stands 130, the second stands 135 and the main body 110 are assembled, the supporting parts 132 would protrude a predetermined distance from the forth surface 114, i.e. the bottom surface, of the main body 110. FIG. 11 is a sectional view taken along line 11-11 of FIG. 7. This configuration can allow the bottom inner flap 330 of the carton 300 to be received between the opposite supporting parts 132, such that the bottom plane of the whole structure is substantially flat along the direction X.

Figure 12:
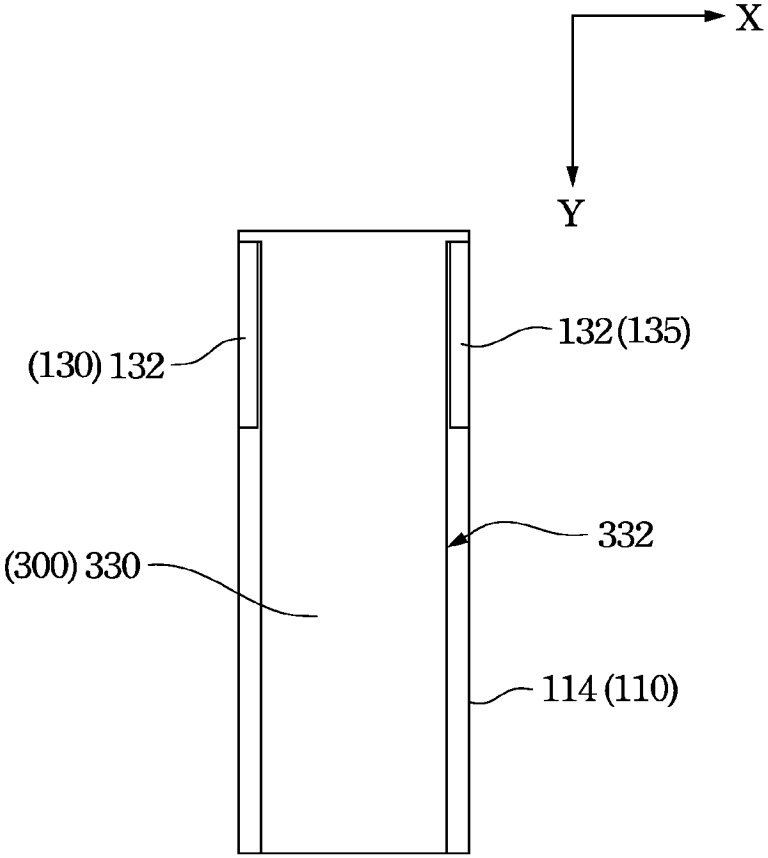
FIG. 12 is a bottom view taken along the arrow 12 of FIG. 11.

FIG. 12 is a bottom view taken along the arrow 12 of FIG. 11. As shown in FIG. 12, the length of the bottom inner flap 330 may be greater than or equal to the length of the forth surface 114, i.e. the bottom surface, of the main body 110 of the cushion 100. That is, the bottom inner flap 330 completely covers the forth surface 114, i.e. the bottom surface, of the main body 110 of the cushion 100 along the direction Y, such that the bottom plane of the whole structure is substantially flat along the direction Y to prevent the cushion 100 from rotating about the direction X.

Furthermore, as shown in FIG. 12, the bottom inner flap 330 may have two fitting indentations 332. The supporting parts 132 respectively fit in the fitting indentations 332 to prevent the supporting parts 132 from interfering with the bottom inner flap 330.

The reader's attention is directed to all papers and documents which are filed concurrently with his specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, 6th paragraph. In particular, the use of "step of" in the claims herein is not intended to invoke the provisions of 35 U.S.C. §112, 6th paragraph.

What is claimed is:

1. A cushion for packaging a product, the cushion comprising:

a main body having a top end and a bottom end;

a slot on the top end of the main body, wherein the product is inserted into the slot;

a receiving space adjacent to the bottom end of the main body and within the main body; and a first stand telescopically inserted in the receiving space, wherein the first stand telescopically slides out of the receiving space to support the cushion in a up-right position.

2. The cushion of claim 1, further comprising:

at least one finger hole disposed in the first stand.

3. The cushion of claim 1, further comprising:

at least one stopping part disposed on the first stand, wherein the stopping part is against an inner surface of the receiving space for stopping the first stand from sliding out of the receiving space when the first stand protrudes a predetermined distance from the receiving space.

4. The cushion of claim 1, further comprising a second stand;

wherein the receiving space is a through hole going through the main body; and wherein the first stand and the second stand are telescopically inserted in opposite sides of the receiving space.

5. The cushion of claim 1, wherein the main body has a receiving space flap defining at least one side wall of the receiving space, the receiving space flap having an insert flap inserted into a gap between the first stand and a bottom surface of the main body.

6. The cushion of claim 1, wherein the receiving space is adjacent to the bottom end and a corner of the main body.

7. The cushion of claim 1, wherein the first stand is L-shape.

8. The cushion of claim 4, further comprising:

a connection part connecting the first stand and the second stand.

9. The cushion of claim 1, wherein the first stand further comprises a flap hole.

10. A cushion comprising:

a main body having a receiving space located on a corner of the main body, the receiving space going through at least one side surface of the main body; and at least one first stand received in the receiving space, wherein the first stand is slidably pulled out of the receiving space with one end connected to the main body and makes contact with the ground to keep the cushion upright.

11. The cushion of claim 10, wherein the main body has an opening in the side surface of the main body and connected to the receiving space; and wherein the first stand has a stopping part disposed on an inner side surface of the first stand, the stopping part protruding from the first stand and being out of a projection of the opening on the inner side surface of the first stand.

12. The cushion of claim 10, wherein the first stand has at least one finger hole in an outer side surface of the first stand.

13. The cushion of claim 10, further comprising:

at least one second stand, both of the first stand and the second stand received in the receiving space, an outer side surface of the second stand exposed from another side surface of the main body.

14. The cushion of claim 13, further comprising:

a first supporting part disposed on an outer side surface of the first stand and protruding from the first stand; and a second supporting part disposed on the outer side surface of the second stand and protruding from the second stand.

15. The cushion of claim 13, wherein the second stand has at least one finger hole in the outer side surface of the second stand.

16. The cushion of claim 10, wherein the main body has a first surface, a second surface, a third surface, and a forth surface, the first surface opposite the third surface, the second surface adjacent to one side of the first surface and one side of the third surface, the forth surface adjacent to another side of the first surface and another side of the third surface, the second surface having a slot therein, the slot going through to the third surface.

17. The cushion of claim 16, wherein the main body has a receiving space flap covering the first surface, the receiving space flap having a side edge connected to the junction of the first surface and the second surface.

18. The cushion of claim 17, wherein the receiving space flap has an insert flap inserted into a gap between the first stand and the forth surface.

19. A package comprising:

a carton for containing a liquid crystal display;

at least one cushion disposed at least in a bottom corner of the carton for filling a void between at least one bottom corner of the liquid crystal display and the carton, the cushion having a bottom end;

a receiving space adjacent to the bottom end of the cushion and within the cushion;

a first stand telescopically inserted in the receiving space;

an opening disposed in the carton to expose the receiving space to allow the first stand to telescopically slide out of the receiving space and the carton to support the package in a up-right position; and a stand flap for covering the opening.

20. The package of claim 19, further comprising:

a plurality of connecting points arranged on an edge of the stand flap and connecting the stand flap to the carton.

21. The package of claim 19, further comprising a second stand;

wherein the receiving space is a through hole going through the cushion; and wherein the first stand and the second stand are telescopically inserted in opposite sides of the receiving space.

22. The package of claim 21, wherein each of the first stand and the second stand has a supporting part protruding a predetermined distance from a bottom surface of the cushion; and wherein the carton has at least one bottom inner flap received between the supporting parts of the first stand and the second stand.

23. The package of claim 22, wherein a length of the bottom inner flap is greater than or equal to a length of the bottom surface of the cushion.

24. The package of claim 19, further comprising:

a flap hole disposed in the first stand and positioned to allow the stand flap to be inserted into the flap hole.

* * * * *